US008904842B2

(12) United States Patent
Saito

(10) Patent No.: US 8,904,842 B2
(45) Date of Patent: Dec. 9, 2014

(54) METHOD FOR PRODUCING METAL WIRE

(75) Inventor: Takayuki Saito, Nasushiobara (JP)

(73) Assignee: Bridgestone Corporation, Tokyo (JP)

( * ) Notice: Subject to any disclaimer, the term of this patent is extended or adjusted under 35 U.S.C. 154(b) by 336 days.

(21) Appl. No.: 13/322,219

(22) PCT Filed: May 12, 2010

(86) PCT No.: PCT/JP2010/058007
§ 371 (c)(1),
(2), (4) Date: Dec. 12, 2011

(87) PCT Pub. No.: WO2010/137457
PCT Pub. Date: Dec. 2, 2010

(65) Prior Publication Data

US 2012/0073346 A1 Mar. 29, 2012

(30) Foreign Application Priority Data

May 28, 2009 (JP) ..... 2009-129109

(51) Int. Cl.
*B21C 1/04* (2006.01)
*B21C 1/14* (2006.01)
*B21C 1/06* (2006.01)

(52) U.S. Cl.
CPC .... *B21C 1/06* (2013.01); *B21C 1/14* (2013.01)
USPC ..... 72/278; 72/289

(58) Field of Classification Search
CPC ..... B21C 1/04; B21C 1/06; B21C 1/14
USPC ..... 72/278, 281, 282, 287, 289, 291
See application file for complete search history.

(56) References Cited

U.S. PATENT DOCUMENTS

| | | | | |
|---|---|---|---|---|
| 3,462,993 | A | 8/1969 | O'Grady | |
| 3,664,169 | A * | 5/1972 | Henrich | 72/278 |
| 3,686,908 | A * | 8/1972 | Krafft | 72/43 |

FOREIGN PATENT DOCUMENTS

| | | | |
|---|---|---|---|
| CN | 201070641 | Y | 6/2008 |
| CN | 201179530 | Y | 1/2009 |
| EP | 0937519 | A2 | 8/1999 |
| JP | 54-095540 | A | 7/1979 |
| JP | 11-123442 | A | 5/1999 |
| JP | 11-239814 | A | 9/1999 |
| JP | 2004-209514 | A | 7/2004 |

OTHER PUBLICATIONS

English language translation of the claims of previously submitted JP 54-095540 published Jul. 28, 1979.
First Office Action issued Aug. 1, 2013 in corresponding Chinese Patent Application No. 201080023378.3 with partial English translation.

* cited by examiner

*Primary Examiner* — Debra Sullivan
(74) *Attorney, Agent, or Firm* — Sughrue Mion, PLLC

(57) ABSTRACT

Provided is a method for producing a metal wire with improved productivity in which a conventional drawing machine is used while wear of a die or occurrence of a break due to the ductility loss thereof is effectively prevented.
Provided is a method for producing a metal wire 1 including a process of drawing a metal wire by using a slip type drawing machine. For a cone 11 of the slip type drawing machine, a cone having an even surface without an inclination angle with respect to the axis of rotation is used, as well as, a die 12 of the slip type drawing machine is positioned such that the metal wire 1 passes a location nearest to a drive unit in the direction parallel to the axis of rotation of the cone 11.

1 Claim, 2 Drawing Sheets

METHOD FOR PRODUCING METAL WIRE

TECHNICAL FIELD

The present invention relates to a method for producing a metal wire (hereinafter, also simply referred to as "a production method"), and particularly to a method for producing a metal wire suitable for a steel cord employed as a reinforcement of a variety of rubber articles such as a tire, and a slip type drawing machine used for the same.

BACKGROUND ART

Conventionally, in a slip type drawing machine used for the final drawing of a wire for a steel cord, as shown in FIG. 3, a cone 21 is formed such that the surface of the cone has an inclination angle of 0.5 to 2.0° with respect to the axis of rotation thereof, as well as, a pass line has been set in which a metal wire 1 is pulled out from a die 22 near the center of the cone in the direction parallel to the axis of rotation.

As a technique with regard to a drawing processing of metal wire, disclosed, for example, in Patent Document 1 as a technique for realizing drawing without generating a problem such as damages on the surface of a wire, break of a wire or premature wear of a die even when the drawing speed is increased, is a multi-stage slip type wet drawing method using a plurality stages of drawing passes each constituted of a die and a capstan which pulls out a wire which has passed on the die, wherein the average slip rate of the drawing pass on each of the stages except for the final stage is set within the range of 5 to 80 m/min.

RELATED ART DOCUMENTS

Patent Documents

Patent Document 1: Japanese Unexamined Patent Application Publication No. H11-239814 (claims or the like)

SUMMARY OF THE INVENTION

Problems to be Solved by the Invention

However, as shown in FIG. 3, in the conventional method in which a cone 21 having an inclination angle is used to pulled out a metal wire 1 from a die 22 near the center of the cone in the direction parallel to the axis of rotation, there have been some cases where a metal wire cannot be pulled out straightly from the die because the actual pass line varies depending on the diameter of the metal wire or the number of the metal wire wound around the cone due to the slide property between the surface of metal wire 1 and the surface of the cone 21. For this reason, as shown in FIG. 4, the die 22 and the metal wire 1 make a partial contact, and an ununiformity of processing caused by the pressure ununiformity is generated, which have resulted in accelerating wear of the die or a ductility loss of the metal wire.

Accordingly, an object of the present invention is to provide a method for producing a metal wire with improved productivity in which a conventional drawing machine is used while wear of a die or occurrence of a break due to the ductility loss thereof is effectively prevented, and to provide a slip type drawing machine used for the method.

Means for Solving the Problems

In order to solve the above problems, the present inventors intensively studied to find that a partial contact between a die and a metal wire can be prevented by adjusting the shape of the cone which is used for a slip type drawing machine and the position where a metal wire is pulled out from a die, whereby wear of the die or a ductility loss of the metal wire can be effectively prevented, thereby completing the present invention.

That is, the method for producing a metal wire according to the present invention including a process of drawing a metal wire by using a slip type drawing machine is characterized in that for the cone of the slip type drawing machine, a cone having an even surface without an inclination angle with respect to the axis of rotation is used, as well as, the die of the slip type drawing machine is positioned such that the metal wire passes a location nearest to a drive unit in the direction parallel to the axis of rotation of the cone.

In the production method according to the present invention, it is preferable that a space of 2 to 5 mm be provided between the die and a holder which holds the die, in the plane orthogonal to the running direction of the metal wire and in the radial direction of the cone.

The slip type drawing machine according to the present invention in which a pair of opposing cones across a die are provided and a metal wire is drawn between the cones is, characterized in that the cone has an even surface without an inclination angle with respect to the axis of rotation, as well as, the die is positioned such that the metal wire passes a location nearest to a drive unit in the direction parallel to the axis of rotation of the cone.

In the slip type drawing machine according to the present invention, it is preferable that a space of 2 to 5 mm be provided between the die and a holder which holds the die, in the plane orthogonal to the running direction of the metal wire and in the radial direction of the cone.

Effect of the Invention

By the present invention, wear of a die or occurrence of a break due to the ductility loss thereof can be effectively prevented. Therefore, by the present invention, a high-speed drawing becomes possible, and an effect of facilitating the drawing of a high strength metal wire is obtained.

MODE FOR CARRYING OUT THE INVENTION

Figure 1A:
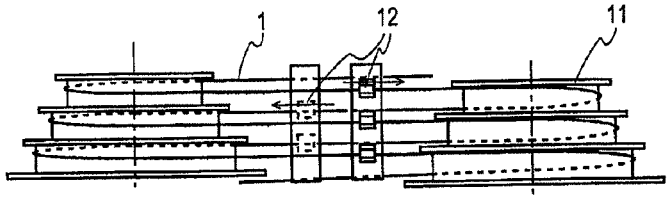
FIGS. 1(*a*) and (*b*) are illustrative drawings of one example of a method for producing a metal wire according to the present invention.
Figure 1B:
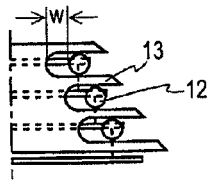

In the following, embodiments of the present invention will now be described in detail with reference to the drawings. FIG. 1(*a*) shows an illustrative drawing of one example of a method for producing a metal wire of the present invention and FIG. 1(*b*) shows an enlarged cross-sectional view of (a) in the vicinity of a die in a direction orthogonal to the running direction of the metal wire. As illustrated, in the production method according to the present invention, a metal wire is drawn by using a slip type drawing machine. In each of FIGS. 1(*a*), 3(*a*), 5(*a*) and 6(*a*), the upside corresponds to the drive side where a drive unit of the drawing machine is located, and the downside corresponds to the working side where a worker is located who performs a die replacement or a wire penetration.

In the present invention, as shown in FIG. 1(*a*), it is important that, for the cone of the slip type drawing machine, a cone 11 which has an even surface without an inclination angle with respect to the axis of rotation be used, as well as, a die 12 be positioned such that a metal wire 1 passes a location nearest to a drive unit in the direction parallel to the axis of rotation of the cone 11.

Figure 2:
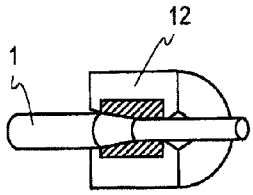
FIG. 2 is an illustrative drawing showing the state of processing of a metal wire of the present invention.

By combining the condition of the shape of the cone and the condition of the position of the die in such a way, the metal wire 1 can be pulled out straightly from the die 12, and the pass line of the metal wire 1 pulled out from the die 12 is stabilized. By this, as shown in FIG. 2, since a partial contact between the metal wire 1 and the die 12 is eliminated and a stress is uniformly applied to the metal wire 1, uniform processing of the metal wire 1 becomes possible, whereby a control of wear of the die 12 and a control of ductility loss of the metal wire 1 become possible.

In the present invention, as shown above and in FIG. 1(*b*), it is preferable that a space w of 2 to 5 mm be provided between the die 12 and a holder 13 (not shown in FIG. 1(*a*)) which holds the die 12, in the plane orthogonal to the running direction of the metal wire 1 and in the radial direction of the cone. Since a space for self-aligning can be reserved by providing the space w of 2 to 5 mm between the die 12 and the holder 13, the metal wire 1 can be pulled out from the die 12 in a more straight state, and the pass line of the metal wire 1 pulled out from the die 12 can be stabilized. When the space w between the die 12 and the holder 13 is less than 2 mm or more than 5 mm, the strength of the holder decreases, or the holder is upsized, which is not preferred.

In the method for producing a metal wire according to the present invention, a slip type drawing machine is suitable which performs drawing such that the conditions of the above-mentioned shape of the cone and the position of the die are satisfied, and by this machine, the desired effect of the present invention can be obtained. Processes other than the drawing process are performed, and the type of the die used for the drawing process and the reduction of area or the like on each of the dies are determined as appropriate according to a common procedure respectively, and not restricted particularly.

As shown in FIG. 1(*a*), in the slip type drawing machine of the present invention, a pair of opposing cones 11 across a die 12 are provided and a metal wire 1 is drawn between the cones 11, and this machine is preferably used in the above production method according to the present invention. The slip type drawing machine according to the present invention may have multi-state cones as shown in the drawings, or separate standalone cones.

In the slip type drawing machine according to the present invention, as shown in the drawings, it is important that the cone 11 have an even surface without an inclination angle with respect to the axis of rotation, as well as, the die 12 be positioned such that the metal wire 1 passes a location nearest to a drive unit in the direction parallel to the axis of rotation of the cone 11. By this, a metal wire 1 can be pulled out straightly from the die 12, and the pass line thereof can be stabilized, whereby the metal wire 1 can be processed uniformly. Effects of controlling wear of the die 12 as well as controlling the ductility loss of the metal wire 1 can also be obtained.

In the slip type drawing machine according to the present invention, as shown in FIG. 1(*b*), it is preferable that a space w of 2 to 5 mm be provided between the die 12 and a holder 13 which holds the die 12, in the plane orthogonal to the running direction of the metal wire 1 and in the radial direction of the cone. Since a space for self-aligning can be reserved by providing the space w of 2 to 5 mm between the die 12 and the holder 13, the metal wire 1 can be pulled out from the die 12 in a more straight state, and the pass line of the metal wire 1 pulled out from the die 12 can be stabilized. When the space w between the die 12 and the holder 13 is less than 2 mm or more than 5 mm, the strength of the holder decreases, or the holder is upsized, which is not preferred.

The slip type drawing machine according to the present invention is suitable in which the conditions of the above-mentioned shape of the cone and the position of the die are satisfied, and by this machine, the desired effect of the present invention can be obtained. Other equipment configurations in detail such as the configuration of the cone or the type of the die are determined as appropriate according to a common procedure, and not restricted particularly.

EXAMPLES

The present invention will now be described in detail by way of Examples.

Conventional Example 1

Figure 3A:
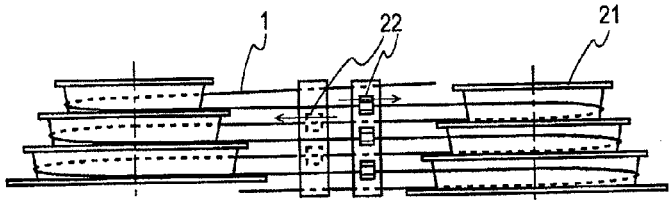
Fig. 3(a) CONVENTIONAL ART
FIGS. 3(*a*) and (*b*) are illustrative drawings of a conventional method for producing a metal wire.
Figure 3B:
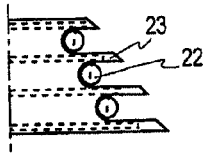
Fig. 3(b) CONVENTIONAL ART
Figure 4:
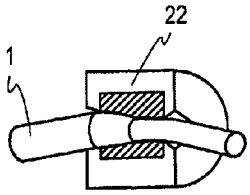
Fig. 4 CONVENTIONAL ART
FIG. 4 is an illustrative drawing showing the conventional state of processing of a metal wire.

A brass plated high tensile strength metal wire for a tire cord was drawn at a constant length of 60,000 m by using the slip type drawing machine shown in FIGS. 3(*a*) and 3(*b*), to determine the wear volume of the die and the number of breaks. The drawing was performed from a diameter of 1.5 mm to 0.2 mm. In the slip type drawing machine shown in FIGS. 3(*a*) and 3(*b*), a cone 21 having an inclination angle of 1.0° with respect to the axis of rotation was used, as well as a die 22 was positioned such that the metal wire 1 passed the center in the direction parallel to the axis of rotation of the cone 21, and further, a space was not provided between the die 22 and a holder 23 which holds the die 22.

Comparative Example 1

Figure 5A:
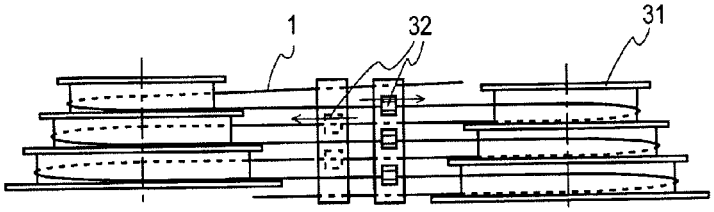
FIGS. 5(*a*) and (*b*) are illustrative drawings of a method for producing a metal wire in Comparative Example.
Figure 5B:
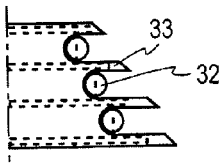

A drawing was performed in the same manner as in Conventional Example 1 except that a slip type drawing machine shown in FIGS. 5(*a*) and 5(*b*) was used, to determine the wear volume of the die and the number of breaks. In the slip type drawing machine shown in FIGS. 5(*a*) and 5(*b*), a cone 31 without an inclination angle with respect to the axis of rotation was used, as well as a die 32 was positioned such that the metal wire 1 passed the center in the direction parallel to the axis of rotation of the cone 31, and further, a space was not provided between the die 32 and a holder 33 which holds the die 32.

Example 1

Figure 6A:
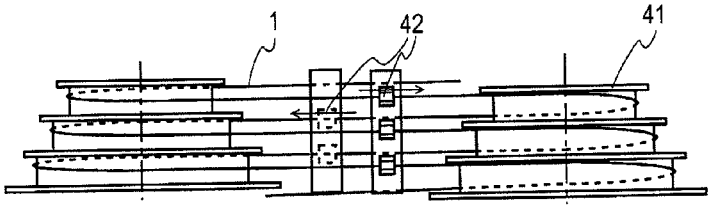
FIGS. 6(*a*) and (*b*) are illustrative drawings of another example of a method for producing a metal wire according to the present invention.
Figure 6B:
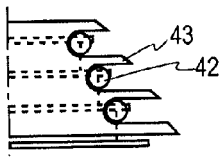

A drawing was performed in the same manner as in Conventional Example 1 except that a slip type drawing machine shown in FIGS. 6(*a*) and 6(*b*) was used, to determine the wear volume of the die and the number of breaks. In the slip type drawing machine shown in FIGS. 6(*a*) and 6(*b*), a cone 41 without an inclination angle with respect to the axis of rotation was used, as well as a die 42 was positioned such that the metal wire 1 passed a location nearest to a drive unit in the direction parallel to the axis of rotation of the cone 41, and further, a space was not provided between the die 42 and a holder 43 which holds the die 42.

Example 2

A drawing was performed in the same manner as in Conventional Example 1 except that a slip type drawing machine shown in FIGS. 1(*a*) and 1(*b*) was used, to determine the wear volume of the die and the number of breaks. In the slip type drawing machine shown in FIGS. 1(*a*) and 1(*b*), a cone 11 without an inclination angle with respect to the axis of rotation was used, as well as a die 12 was positioned such that the metal wire 1 passed a location nearest to a drive unit in the direction parallel to the axis of rotation of the cone 11, and further, a space of 3 mm was provided between the die 12 and a holder 13 which holds the die 12, in the plane orthogonal to the running direction of the metal wire and in the radial direction of the cone.

The obtained measurement results of the wear volume of the dies and the number of breaks in Conventional Example 1, Comparative Example 1 and Examples 1 and 2 are shown as indices based on Comparative Example 1, in the Table 1 below.

TABLE 1

| | Type of cone | Pull out location | Space between dice and holder | Dice wear index | Break index |
|---|---|---|---|---|---|
| Conventional Example 1 | With inclination | Center in the cone width direction | None | Stand-ard | Stand-ard |
| Comparative Example 1 | Even | Center in the cone width direction | None | −5% | −5% |
| Example 1 | Even | Drive side in the cone width direction | None | −30% | −30% |
| Example 2 | Even | Drive side in the cone width direction | Exist | −50% | −50% |

Conventional Example 2, Comparative Example 2 and Examples 3 and 4

Drawings were performed in the same conditions as in Conventional Example 1 and the like except that a drawing was performed from the diameter of the wire of 1.8 mm to 0.3 mm respectively, to determine the wear volume of the die and the number of breaks. The measurement results thereof are shown as indices based on Conventional Example 2 in the Table 2 below.

TABLE 2

| | Type of cone | Pull out location | Space between dice and holder | Dice wear index | Break index |
|---|---|---|---|---|---|
| Conventional Example 2 | With inclination | Center in the cone width direction | None | Stand-ard | Stand-ard |
| Comparative Example 2 | Even | Center in the cone width direction | None | −3% | −3% |
| Example 3 | Even | Drive side in the cone width direction | None | −18% | −18% |
| Example 4 | Even | Drive side in the cone width direction | Exist | −30% | −30% |

As is obvious from the results in the above Tables, in each Example where a drawing was performed such that for the cone of the slip type drawing machine, a cone having an even surface was used, and the die was positioned such that the metal wire passed a location nearest to a drive unit in the direction parallel to the axis of rotation of the cone, it was confirmed that the wear of the die can be considerably controlled and the occurrence of breaks can be considerably reduced as compared with each of the Conventional Examples and Comparative Examples in which such conditions are not satisfied.

REFERENCE SIGNS LIST

1 metal wire

11,21,31,41 cone

12,22,32,42 die

13,23,33,43 holder

The invention claimed is:

1. A slip type drawing machine in which a pair of opposing cones across a die are provided and a metal wire is drawn between the cones, wherein each cone has an even surface without an inclination angle with respect to an axis of rotation, and the die is positioned such that the metal wire passes a location nearest to a drive unit in a direction parallel to the axis of rotation of each cone, wherein a space of 2 to 5 mm is provided between the die and a holder which holds the die in a plane orthogonal to a running direction of the metal wire and in a radial direction of each cone.

* * * * *